US007797908B2

(12) United States Patent
Keys

(10) Patent No.: US 7,797,908 B2
(45) Date of Patent: Sep. 21, 2010

(54) METAL FRAMING MEMBER

(75) Inventor: James F. Keys, Northville, MI (US)

(73) Assignee: Shiloh Industries, Inc., Valley City, OH (US)

( * ) Notice: Subject to any disclaimer, the term of this patent is extended or adjusted under 35 U.S.C. 154(b) by 184 days.

(21) Appl. No.: 11/980,235

(22) Filed: Oct. 30, 2007

(65) Prior Publication Data

US 2008/0115445 A1 May 22, 2008

Related U.S. Application Data

(60) Provisional application No. 60/860,630, filed on Nov. 22, 2006.

(51) Int. Cl.

| | |
|---|---|
| ***E04C 2/34*** | (2006.01) |
| ***E04C 3/00*** | (2006.01) |
| ***E04C 2/38*** | (2006.01) |
| ***E04B 1/18*** | (2006.01) |
| ***B21K 23/00*** | (2006.01) |

(52) U.S. Cl. ..... 52/846; 52/481.1; 52/481.2; 52/717.02; 52/838; 52/844; 52/636; 52/854; 29/897.35

(58) Field of Classification Search ..... 52/481.1, 52/481.2, 717.02, 838, 844, 846, 851–855; 29/897.35

See application file for complete search history.

(56) References Cited

U.S. PATENT DOCUMENTS

| | | | | | |
|---|---|---|---|---|---|
| 1,741,423 | A | * | 12/1929 | Lachman | 52/636 |
| 2,180,317 | A | * | 11/1939 | Davis | 52/319 |
| 3,050,831 | A | * | 8/1962 | Diamond | 29/897.31 |
| 3,283,464 | A | * | 11/1966 | Litzka | 52/636 |
| 4,152,873 | A | * | 5/1979 | Burke | 52/1 |
| 4,894,898 | A | * | 1/1990 | Walker | 29/897.35 |
| 5,315,804 | A | | 5/1994 | Attalla | |
| 5,568,714 | A | * | 10/1996 | Peterson | 52/786.13 |
| 5,588,273 | A | | 12/1996 | Csagoly | |
| 5,661,881 | A | * | 9/1997 | Menchetti | 29/6.1 |
| 5,669,197 | A | | 9/1997 | Bodnar | |
| 6,758,022 | B1 | * | 7/2004 | Coll et al. | 52/690 |

FOREIGN PATENT DOCUMENTS

EP 1760215 A1 3/2007

OTHER PUBLICATIONS

International Search Report for PCT/US07/22887, Apr. 4, 2008, 3 pgs.

* cited by examiner

*Primary Examiner*—Brian E Glessner
*Assistant Examiner*—Omar Hijaz
(74) *Attorney, Agent, or Firm*—Reising Ethington P.C.; Michael C. Adams

(57) ABSTRACT

A metal framing member for use in a wide variety of applications including interior and exterior walls, structural insulated panels (SIPs), as well as floors, ceilings and roofs of residential and commercial buildings, to name but a few. The metal framing member generally includes first and second metal components, where each of the metal components is a separate piece and includes an elongated support with a series of fingers extending therefrom. The two metal components are attached together near tips of the fingers so that an alternating sequence of fingers and spaces is formed in an intermediate area between the two supports. This sequence can result in weight, material and cost savings, reduced thermal and acoustic conductivity across the metal framing member, and trade-ready holes for passing through items such as wires, pipes, etc.

16 Claims, 3 Drawing Sheets

METAL FRAMING MEMBER

REFERENCE TO RELATED APPLICATIONS

This application claims the benefit of U.S. Provisional Ser. No. 60/860,630 filed on Nov. 22, 2006, the entire contents of which are incorporated herein by reference.

FIELD OF INVENTION

The present invention relates generally to building materials, and more particularly, to metal framing members that can be used as studs, tracks, bars, channels, headers, joists, trusses, rafters, and other framing components, to name but a few possibilities.

BACKGROUND OF THE INVENTION

Metal framing members have been used for quite some time in the areas of commercial and residential construction and can offer a number of advantages over alternative building materials, such as wood. For example, metal framing members enjoy strict dimensional tolerances which result in consistent strength, straightness and dimensionally stability. Moreover, metal framing members provide excellent design flexibility due to the variety of available sizes and thicknesses, as well as their inherent strength-to-weight ratio which allows them to span longer distances and better resist wind and other natural forces. It is also beneficial that metal framing members are more resistant than wood when it comes to fire, warping, splitting, cracking, rotting, and termite and rodent infestation, to name but a few benefits.

Although metal framing members exhibit these and numerous other qualities, there are some challenges associated with their use in construction. For instance, metal is generally a better conductor of sound and heat than is wood. Thus, the use of metal framing members in interior walls can diminish desired acoustic damping effects, while the use of metal framing members in exterior walls can contribute to increased energy costs, especially when used in extremely cold or warm environments.

SUMMARY OF THE INVENTION

According to one aspect, there is provided a metal framing member that comprises first and second metal components. The first metal component has a first support and a first plurality of fingers, and the second metal component has a second support and a second plurality of fingers, wherein the first and second metal components are separate components that are attached to one another near tips of the first and second pluralities of fingers.

According to another aspect, there is provided a metal framing member that comprises first and second metal components. The first metal component has a first support, and the second metal component has a second support, wherein an intermediate area located between the first and second supports is generally occupied by an alternating sequence of fingers and spaces.

According to another aspect, there is provided a method for manufacturing a metal framing member. The method comprises the steps of: (a) making a wave-like cut generally along the length of an elongated piece of metal to form first and second metal components each having a plurality of fingers; (b) separating the first and second metal components; (c) aligning the first and second metal components so that tips of the first and second pluralities of fingers are generally aligned with one another; and (d) welding the first and second metal components together near the tips.

DESCRIPTION OF THE DRAWINGS

A preferred exemplary embodiment of the invention will hereinafter be described in conjunction with the appended drawings, wherein like designations denote like elements, and wherein.

DESCRIPTION OF PREFERRED EMBODIMENTS

Figure 1:
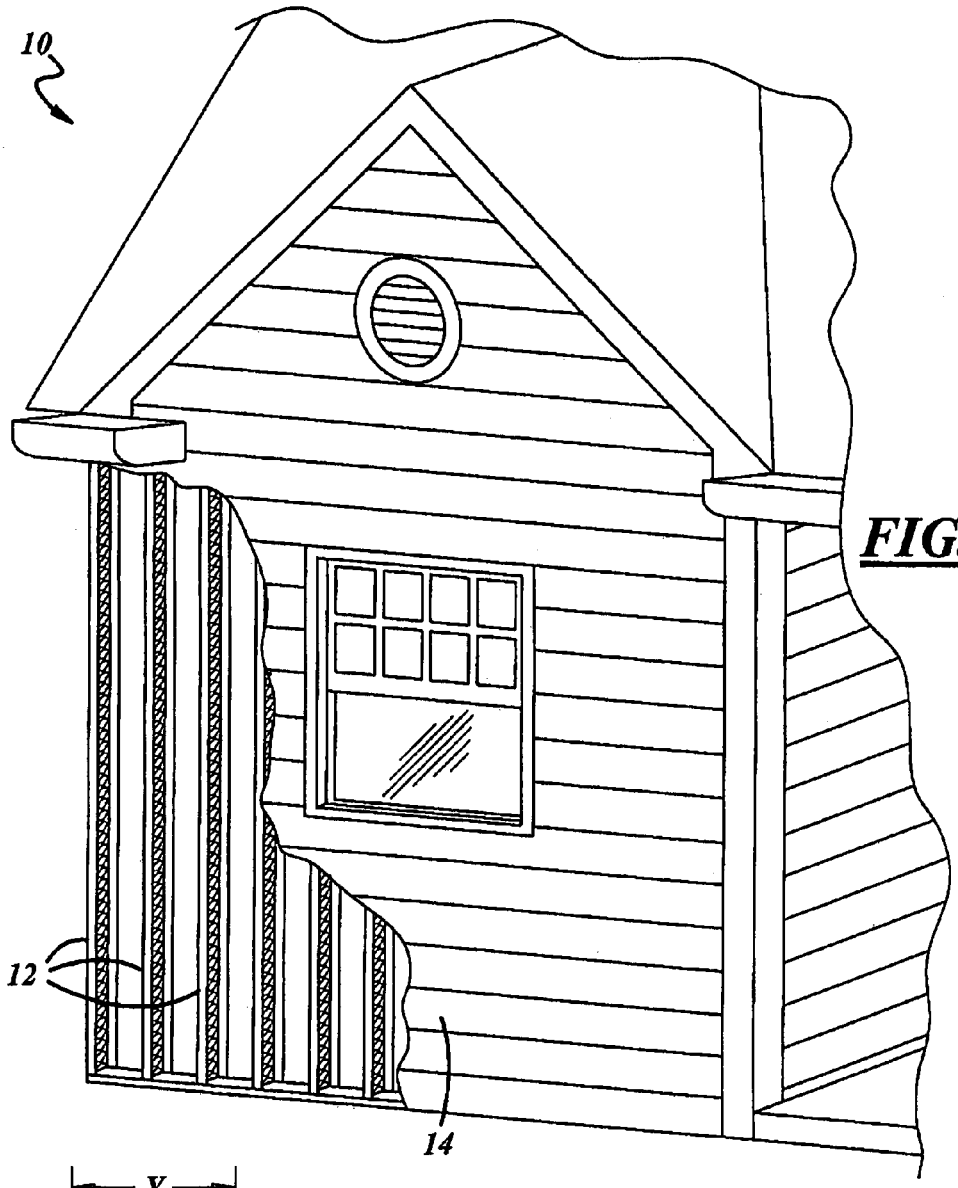
FIG. 1 shows an exemplary embodiment of a metal framing member being used as a stud or vertical support in an exterior wall.

The metal framing member described herein can be used in a wide variety of applications including, for instance, interior and exterior walls, structural insulated panels (SIPs), as well as floors, ceilings and roofs of residential and commercial buildings. Some examples of specific types of structural components include studs, tracks, bars, channels, headers, joists, trusses and rafters. Although FIG. 1 is a graphical depiction of a residential building 10 utilizing a number of vertically-aligned metal framing members 12 as studs in an exterior wall 14, it should be appreciated that the metal framing member described below could just as easily be used in commercial buildings, in interior walls, and as framing members other than studs, to name but a few possibilities.

Figure 4:
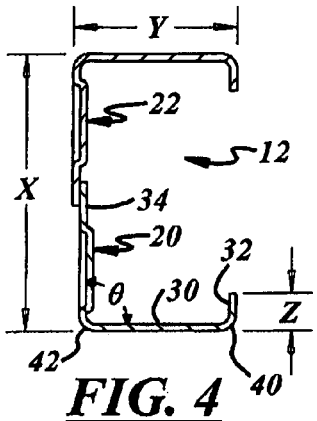
FIG. 4 is a cross-sectional view of the metal framing member of FIG. 2 taken along a line 4-4.
Figure 2:
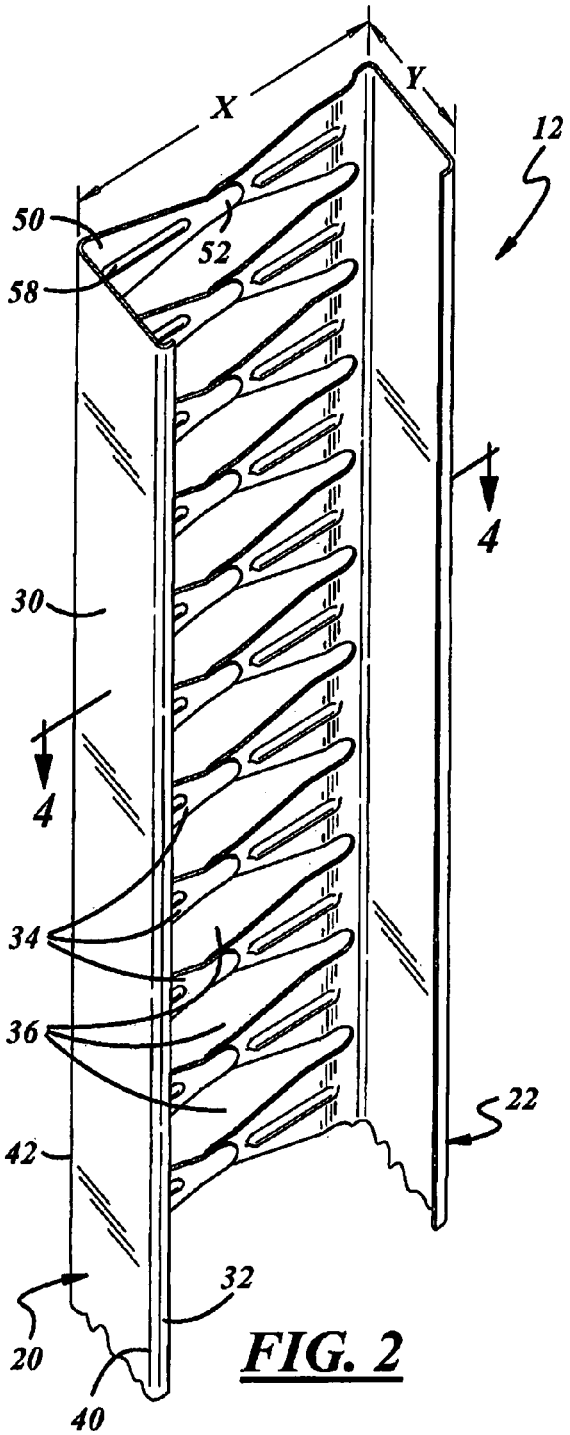
FIG. 2 is an isometric view of the metal framing member of FIG. 1.
Figure 3:
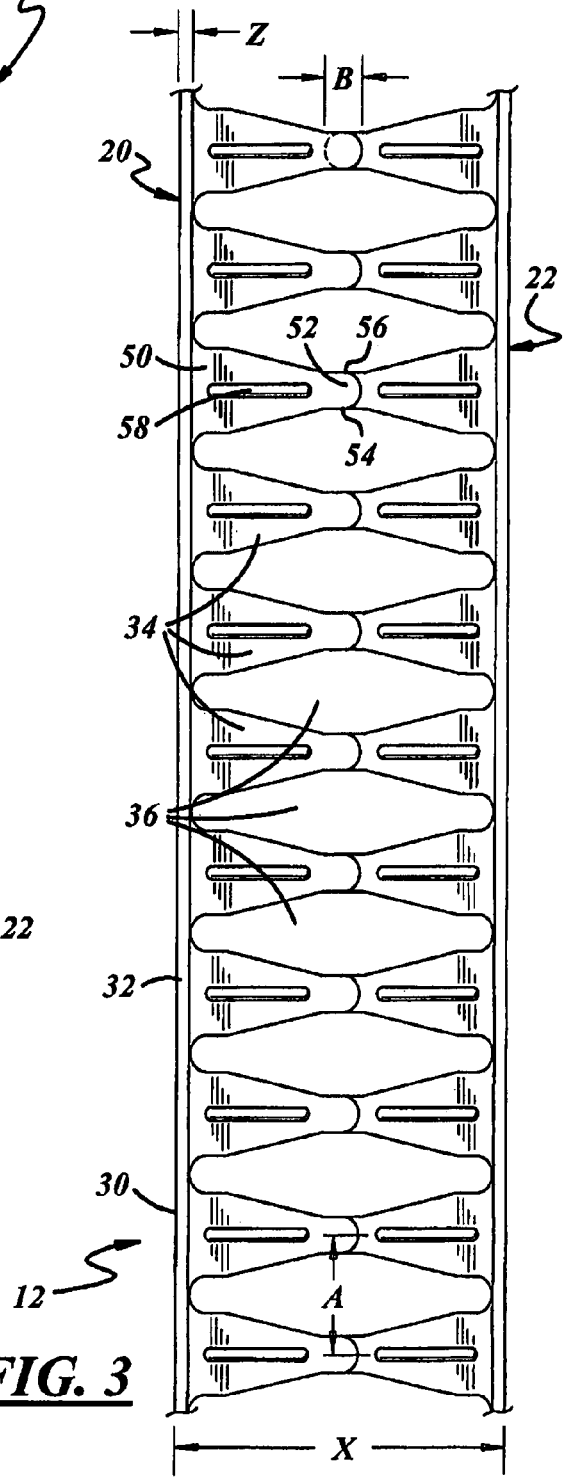
FIG. 3 is a side view of the metal framing member of FIG. 1.

With reference to FIGS. 2-4, there is shown an embodiment of an elongated metal framing member 12 that can be used as a stud in a non-load bearing wall. Although the thickness and dimensions of the framing member will usually be dictated by the requirements of the particular application in which it is to be used, metal framing member 12 is preferably constructed from 12-20 gauge galvanized cold-formed steel and has a width dimension X of 2"-14", a depth dimension Y of 1"-4", and a return dimension Z of ⅛"-2". Metal framing member 12 generally includes a first metal component 20 securely attached to a second metal component 22, however, because of their similarity only the first metal component will be subsequently described. It should be appreciated that the following description applies equally to the second metal component as well.

First metal component 20 is generally an elongated L-shaped member that includes a support 30, a return 32 and a series of alternating fingers 34 and spaces 36. Support or flange 30 is preferably a flat metal strip that can function as a bearing surface for cladding materials like drywall or sheetrock, oriented strand board (OSB), glass, tile, metal, stone, etc. Return 32 is a small lip that is integrally joined to and projects from a first lengthwise edge 40 of the support and increases the structural integrity of the metal framing member. It should be recognized that even though return 32 is shown here as a short, flat lip extending from edge 40 at a 90° angle (see FIG. 4), the return could instead be a compound component with several folds, angles, etc. (see FIG. 5) and could extend from the edge at an angle other than 90°.

Figure 6:
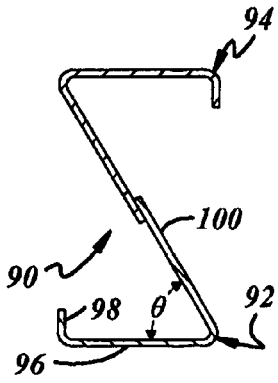

Fingers or sprags 34 are projections that are integrally joined to a second lengthwise edge 42 of the support and extend away from the support according to an inside angle θ. According to the particular embodiment shown here, the inside angle θ is approximately 90° so that the finger extends downwardly in a direction that is generally parallel to return 32. However, other embodiments, like that shown in FIG. 6, are envisioned where the inside angle θ is an acute angle and is thus less than 90°. An embodiment is even envisioned where one or more of the fingers 34 extend away from support 30 in a twisted manner so that they form helix-like members. The fingers of the two metal components 20, 22 are preferably mirror images of one another and are arranged in a generally coplanar fashion so that a series of spaces 36 are formed therebetween. As demonstrated in FIG. 4, the fingers 34 of the first metal component 20 can lie slightly on one side (in that case, the inside) of the fingers of the second metal component 22 and are therefore not precisely in the same plane; thus, the term 'coplanar' is used here in a broader context to describe fingers that are generally parallel to one another and generally lie in the same plane, albeit not exactly. In FIGS. 2-3, fingers 34 are shown as tapered, finger-like projections that extend from a wider proximal base portion 50, which is located near edge 42 of the support, to a narrower distal tip portion 52. However, it should be appreciated that other finger configurations could be used as well, including configurations that are generally triangular, square, rectangular, circular, oblong or sinusoidal, to name but a few possibilities. As best seen in FIG. 3, tip portion 52 can include a bulb-like distal end having first and second parallel sides 54, 56 that provide a better mating surface for improved attachment to a complementary finger or sprag of second metal component 22, as will be subsequently described in more detail. Strengthening ribs 58 or other surface features like stipples can be added to the fingers, support or return to help buttress them and improve structural integrity.

Spaces or interstices 36 are located between fingers 34 and provide metal framing member 12 with a number of desirable qualities, including material and weight reductions, reduced thermal conductivity, and trade-ready holes for plumbing, electrical and communications equipment, to cite but a few examples. More specifically, spaces 36 can result in a significant amount of both weight and material savings when compared with similar metal framing members that have a solid or largely solid piece connecting the two supports together. Unlike other metal framing members where holes are punched out of an otherwise solid piece such that cutouts become scrap, spaces 36 are preferably complementary in shape to fingers 34 so that the production of first and second metal components 20, 22 creates no additional scrap metal. Also, the alternating sequence of spaces 36 and fingers 34 interrupts or reduces thermal and/or acoustic conductivity through metal framing member 12. Put differently, because first and second metal components 20, 22 are only connected at the tips 52 of fingers 34, instead of across a solid or semi-solid metal piece, the ability of metal framing member 12 to conduct thermal and/or acoustic energy is reduced and so are resultant energy losses; this is particularly true when the metal framing member is part of an exterior wall that is used in extreme climate environments. Spaces 36 also provide trade-ready access holes so that pipes, electrical wires, phone and fiber optic lines, for example, can be passed through the metal framing member without having to punch-out or otherwise create new holes. It is also possible to easily fill spaces 36 with insulation or another material, such as the type that is injected or sprayed into walls once they are formed. Although the spaces 36 shown in the drawings are diamond-shaped and are equal in size, it is of course possible to provide spaces with different shapes or non-uniform spaces such that some are larger or smaller than others. For instance, in those areas where additional strength or rigidity is needed from the metal framing member, spaces could be made smaller which has the effect of increasing the amount of material bridging the two supports together.

Figure 5:
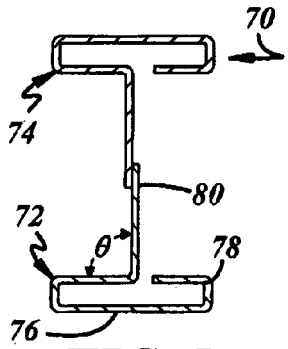
FIGS. 5-6 are cross-sectional views of different embodiments of metal framing members.

FIGS. 5 and 6 show different embodiments of metal framing members having cross-sectional configurations that are different from that previously described. In FIG. 5, metal framing member 70 has an I-shaped cross-section and, like metal framing member 12, generally includes first and second metal components 72, 74. Each of the metal components 72, 74 includes a support 76, a compound return 78 and a series of fingers or sprags 80 extending away from the support according to an inside angle θ. Similarly, the metal framing member 90 shown in FIG. 6 includes upper and lower metal components 92, 94 that are attached to one another such that they form a metal framing member with a Z-shaped cross-section. Both metal components 92, 94 have a support 96, a return 98 and a number of fingers or sprags 100 extending from the support at an inside angle θ that, according to this particular arrangement, is an acute angle. It should of course be appreciated that the foregoing embodiments are simply examples of some of the possible cross-sectional configurations that could be used with the metal framing member of the present invention and that other configurations known to those skilled in the art could be used as well.

Figure 7:
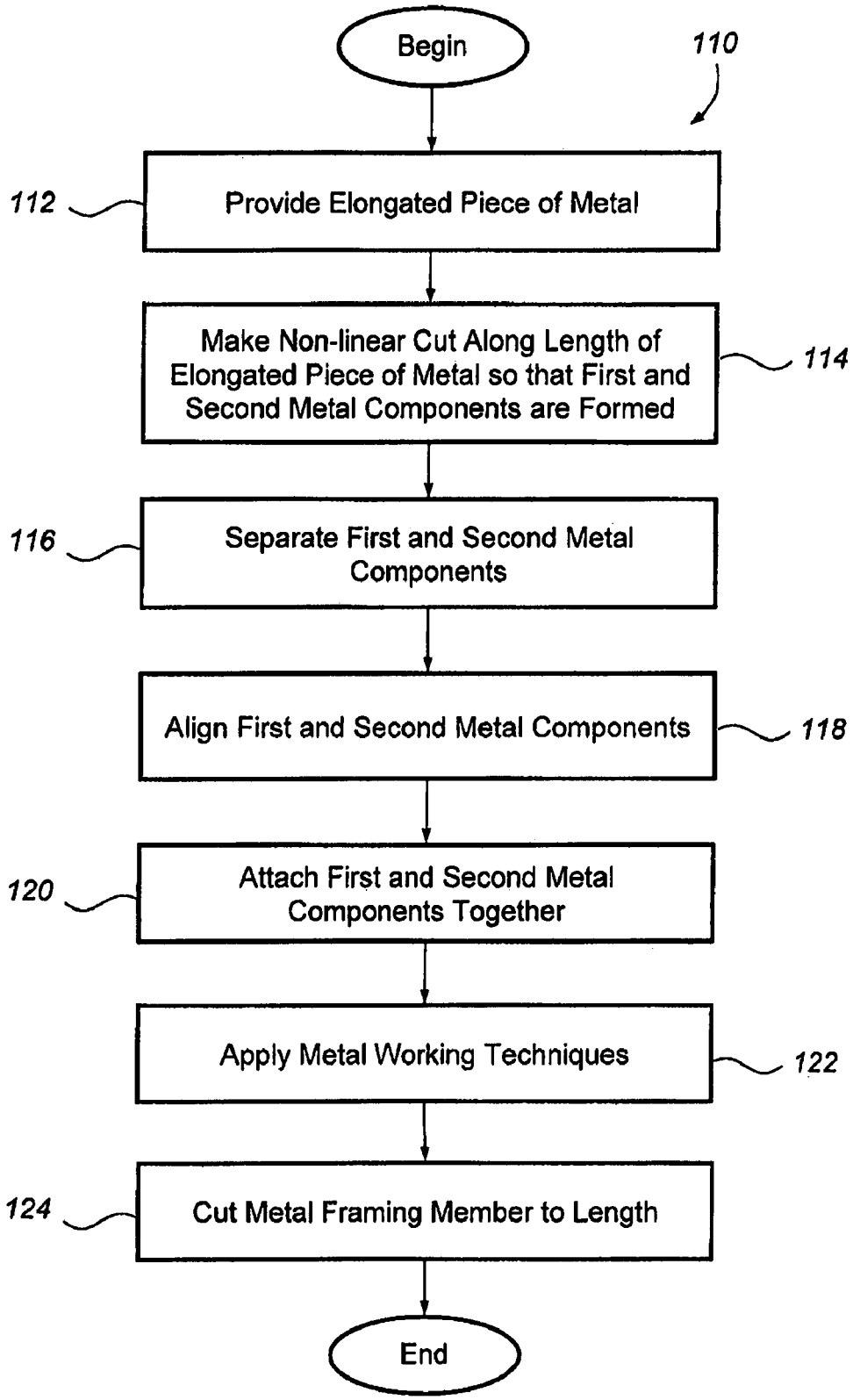
FIG. 7 is a flowchart demonstrating some of the steps of an embodiment of a method for manufacturing a metal framing member.

Turning now to FIG. 7, there are shown some of steps of an embodiment of a method 110 that could be used to manufacture metal framing member 12. In step 112, an elongated piece of metal, preferably galvanized cold-formed steel, is provided. That piece of metal can simply be a planar, non-formed piece of metal having a uniform thickness or it can be provided in a pre-formed state. For example, the metal piece provided in step 112 could come with support 30, return 32 and/or other features already formed on the work piece, thus, eliminating the need for subsequent forming or bending steps. Also, the metal work piece could be provided with a non-uniform thickness which is the result of a cold reduction process or the like. While it is preferable that these forming and/or cold reduction steps take place after fingers 34 have been cut, as will be described next, any one of a number of step sequences are possible and could be used.

Next, a non-linear or wave-like cut is made along a length of the elongated metal piece in step 114 in order to form separate first and second metal components 20, 22. As is appreciated by skilled artisans, there are a number of different metal cutting techniques that could be used to make this cut, including scroll slitting, roll lancing, laser cutting and water jet, for example. According to one embodiment, a scroll slitting machine is used to cut the metal work piece along a zigzag-like or wave-like cut that generally extends the length of the metal work piece. This not only cuts the elongated metal work piece into first and second metal components 20, 22, it simultaneously forms two sets of fingers or sprags in a single cutting operation. By making each finger 34 the same size and shape, and by spacing one finger from the next by a common distance A, also referred to as the pitch, two sets of complementary fingers and spaces are formed which are generally mirror images of one another. This type of arrangement allows for a subsequent alignment of the fingers and improves the efficiency of the manufacturing process, as no wasted material is produced. Stated differently, by making a single back-and-forth cut along the length of the elongated metal piece, the present method is able to create two sets of generally symmetrical fingers in a single cutting operation, and is able to do so without creating any wasted material. Of course, additional features, such as strengthening ribs 58, could be rolled, stamped or otherwise formed at the same time as step 114, such that additional manufacturing steps are eliminated.

Now that that first and second metal components 20, 22 have been cut, they are pulled apart and separated from one another, step 116. This could, of course, be performed manually or automatically on the same cutting line or it could be performed at a later station. Next, the first and second metal components are aligned with one another so that the tips of the fingers of first metal component 20 are generally aligned with the tips of the fingers of second metal component 22, step 118. The two metal components 20, 22 could be aligned according to one of a number of different ways. In some instances, it is desirable to have all of the fingers 34 from the first metal component 20 arranged on the inside of the fingers from the second metal component 22 such that they are facing the interior of the metal framing member (embodiment shown in FIGS. 2-4), or vice-versa. In other cases, it may be desirable to arrange the fingers of the two metal components in an alternating or interleaved fashion (not shown) such that some of the fingers from metal component 20 are arranged on the inside of the fingers from metal component 22, while the other fingers from metal component 20 are located on the outside of the fingers from metal component 22. These are, of course, only examples of some of the possible arrangements as others exist and could be used.

When the two metal components are brought together the sequence of fingers and spaces generally occupies an intermediate area located between the two elongated supports of the metal components. This intermediate area is preferably made of at least forty percent (40%) spaces, which can result in weight and material reductions and disrupt thermal and acoustic transmissions, as previously explained. The embodiment shown in FIG. 3 has an intermediate area where approximately fifty percent (50%) is occupied by spaces 36. The amount of overlap B between the fingers of the first and second metal components 20, 22 is another parameter that could be adjusted according to the particular requirements of the metal framing member being formed. For example, in applications where additional strength is needed, the two sets of fingers could be aligned in a more overlapping manner so that dimension B is increased. This would provide more material on each of the fingers for attachment therebetween. Manipulation of dimension B could also be used to adjust the width dimension X of the metal framing member, as greater overlap B results in a smaller overall width X.

Once the first and second metal components 20, 22 are aligned, they are attached to one another according to one of a number of attachment methods, step 120. In one embodiment, the first and second metal components are attached to one another at the tips of their respective sprags according to a mash-seam welding technique. This technique generally involves a pair of rotating conductive wheels that serve as welding electrodes by applying pressure and electrical current to the metal pieces that are being welded together. In this particular embodiment, after the tips of the sprags have been aligned in an overlapping arrangement, the overlapped sections are passed between the two narrowly separated wheel electrodes which simultaneously crush and weld them together. Other possible attachment techniques include various forms of laser welding, resistance welding, adhesives, mechanical fasteners, etc. and could be used as well.

Now, depending on the specific application in which the metal framing member is to be used, it may be desirable in step 122 to subject the metal framing member to one or more metal working techniques, such as cold reduction, roll embossing or metal bending. In a cold reduction process, the metal work piece is rolled through a press so that the rolled steel becomes stronger, thinner and smoother in response to the application of pressure. As an example, the newly attached first and second metal components 20, 22 could be inserted into a cold reduction machine such that only the intermediate area between the elongated supports is subjected to compressive forces. This type of localized cold reduction would thin out the material comprising the fingers and would likely increase the width dimension X without affecting the depth dimension Y or the return dimension Z. Furthermore, this type of localized cold reduction could be used with work pieces that have already been formed into their desired cross-sectional shape, or with work pieces that have not yet been formed with support 30 and/or return 32. In addition to other benefits, the cold reduction process, which is an optional processing step, thins out the material so that a resultant work piece having a desired pitch A can be achieved.

If metal framing member 12 still needs to have features such as support 30 or return 32 added, then step 122 further includes a metal forming or bending step for producing such features. As previously mentioned, it is possible to receive the elongated metal pieces with support 30 and return 32 already formed; in such a case, the metal bending portion of step 122 could be omitted as there is no need to form those features twice. Lastly, the newly formed metal framing member 12 is cut to length, step 124, according to one of a number of different cutting techniques known and used in the art.

It is to be understood that the foregoing description is not a definition of the invention itself, but is a description of one or more preferred exemplary embodiments of the invention. The invention is not limited to the particular embodiment(s) disclosed herein. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. For example, the particular manufacturing method described in conjunction with FIG. 7 is only an exemplary sequence of steps, as numerous other sequences could alternatively be used, including those with additional steps, omitted steps, and/or different steps. All such other embodiments, changes, and modifications are intended to come within the scope of the appended claims.

As used in this specification and claims, the terms "for example", "for instance", "like", and "such as," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

The invention claimed is:

1. A metal framing member, comprising:

a first metal component having a first support and a first plurality of fingers generally extending from the first support; and a second metal component having a second support and a second plurality of fingers generally extending from the second support, each of the first and second pluralities of fingers includes at least one finger that is a tapered member and extends from a wider proximal base portion to a narrower distal tip portion;

wherein the first and second metal components are separate components that are attached to one another near tips of the first and second pluralities of fingers, and the tips of the first and second pluralities of fingers are overlapped with one another at one or more bulb-like ends.

2. The metal framing member of claim 1, wherein the first and second supports are generally parallel to one another, and each of the supports includes: i) a first lengthwise edge having a return extending from at least a portion thereof, ii) a second lengthwise edge having a plurality of fingers extending from at least a portion thereof, and iii) a bearing surface located between the first and second lengthwise edges.

3. The metal framing member of claim 1, wherein the metal framing member is generally configured according to at least one cross-sectional shape selected from the list consisting of: a C-shaped cross-section, an I-shaped cross-section, and a Z-shaped cross-section.

4. The metal framing member of claim 1, wherein the first and second pluralities of fingers are generally: i) coplanar, ii) mirror images of one another, and iii) attached to one another so that a series of spaces are formed in between the fingers.

5. The metal framing member of claim 1, wherein each of the first and second pluralities of fingers includes at least one finger that extends from a base portion to a tip portion according to an inside angle θ that is 90° or less.

6. The metal framing member of claim 1, wherein each of the first and second pluralities of fingers includes at least one finger that includes a strengthening rib generally extending along the length of the finger.

7. The metal framing member of claim 1, wherein all of the tips of the first plurality of fingers are attached to one side of the tips of the second plurality of fingers.

8. The metal framing member of claim 1, wherein the tips of the first plurality of fingers are attached to both sides of the tips of the second plurality of fingers so that they are generally interleaved.

9. A metal framing member, comprising:

a first metal component having a first support and a first plurality of fingers; and a second metal component having a second support and a second plurality of fingers, each of the first and second pluralities of fingers includes at least one finger that is a tapered member and extends from a wider proximal base portion to a narrower distal tip portion;

wherein an intermediate area located between the first and second supports is generally occupied by an alternating sequence of fingers and spaces, and the first and second metal components are attached to one another at overlapping tips of the first and second pluralities of fingers which include one or more bulb-like ends.

10. The metal framing member of claim 9, wherein the first and second supports are generally parallel to one another, and each of the supports includes: i) a first lengthwise edge having a return extending from at least a portion thereof, ii) a second lengthwise edge having a plurality of fingers extending from at least a portion thereof, and iii) a bearing surface located between the first and second lengthwise edges.

11. The metal framing member of claim 9, wherein the metal framing member is generally configured according to at least one cross-sectional shape selected from the list consisting of: a C-shaped cross-section, an I-shaped cross-section, and a Z-shaped cross-section.

12. The metal framing member of claim 9, wherein the alternating sequence of fingers and spaces includes at least one space that is sized to be a trade-ready access hole for receiving one or more types of building materials.

13. The metal framing member of claim 9, wherein the alternating sequence of fingers and spaces includes at least one space that is designed to reduce thermal and/or acoustic transmissions between the first and second metal components.

14. The metal framing member of claim 9, wherein the alternating sequence of fingers and spaces includes a pair of adjacent fingers and a pair of adjacent spaces, the pair of adjacent fingers is spaced according to the same pitch (A) as the pair of adjacent spaces.

15. The metal framing member of claim 9, wherein the alternating sequence of fingers and spaces includes at least one space that is generally arranged in the shape of a diamond.

16. The metal framing member of claim 11, wherein at least forty percent (40%) of the intermediate area located between the first and second supports is comprised of spaces.

* * * * *

UNITED STATES PATENT AND TRADEMARK OFFICE

CERTIFICATE OF CORRECTION

PATENT NO. : 7,797,908 B2
APPLICATION NO. : 11/980235
DATED : September 21, 2010
INVENTOR(S) : James F. Keys It is certified that error appears in the above-identified patent and that said Letters Patent is hereby corrected as shown below:

In the patent, column 8, line 40, claim 16 after "claim", delete "11" and insert --9--

Signed and Sealed this

Thirtieth Day of November, 2010

David J. Kappos

David J. Kappos
*Director of the United States Patent and Trademark Office*